US005957819A

United States Patent [19]

Cortesi

[11] Patent Number: 5,957,819

[45] Date of Patent: Sep. 28, 1999

[54] GOLF EXERCISE DEVICE

[76] Inventor: Gary A. Cortesi, 625 Huntington Commons Rd., Mt. Prospect, Ill. 60056

[21] Appl. No.: 08/971,374

[22] Filed: Nov. 17, 1997

[51] Int. Cl.[6] ..... A63B 21/04

[52] U.S. Cl. ..... 482/121; 482/129; 482/904

[58] Field of Search ..... 248/214, 215, 248/301; 24/312, 3, 11; 224/269, 271, 272; 211/70.2; 482/121–30, 904

[56] References Cited

U.S. PATENT DOCUMENTS

| | | | |
|---|---|---|---|
| D. 184,508 | 3/1954 | Burt | 248/300 |
| 2,623,583 | 12/1952 | Handley | 248/215 |
| 3,536,628 | 10/1970 | Kramer | 248/301 |
| 3,618,949 | 11/1971 | Bates . | |
| 4,328,964 | 5/1982 | Walls | 482/129 |
| 4,475,676 | 10/1984 | Smith | 224/269 |
| 4,558,838 | 12/1985 | Klein | 248/300 |
| 4,577,862 | 3/1986 | Sagedahl . | |
| 4,580,778 | 4/1986 | Van Noord . | |
| 4,592,545 | 6/1986 | Sagedahl et al. . | |
| 4,681,317 | 7/1987 | Brandell . | |
| 4,872,671 | 10/1989 | Brandell . | |
| 4,944,518 | 7/1990 | Flynn | 273/186 |
| 5,007,635 | 4/1991 | Tiller | 482/129 |
| 5,158,299 | 10/1992 | Otter | 273/186.2 |
| 5,205,803 | 4/1993 | Zemitis | 482/121 |
| 5,209,481 | 5/1993 | DeBack | 273/186.2 |
| 5,209,482 | 5/1993 | Hopfer | 273/187.2 |
| 5,277,683 | 1/1994 | Wilkins | 482/129 |
| 5,312,107 | 5/1994 | Gvoich et al. | 273/186.1 |
| 5,314,396 | 5/1994 | Parr | 482/126 |
| 5,407,414 | 4/1995 | Bass | 482/129 |
| 5,431,617 | 7/1995 | Rattray, Jr. | 482/129 |
| 5,636,734 | 6/1997 | Smith | 211/70.2 |

*Primary Examiner*—Jerome W. Donnelly
*Attorney, Agent, or Firm*—Olson & Hierl, Ltd.

[57] ABSTRACT

A golfer exercise device is provided which includes a rigid strip member that is associated with a hanger portion and a golf club attachment portion. The hanger portion has a top from which the rigid strip depends. The hanger portion engages an upper edge portion of a door while the strip rests against a vertical surface portion of the door. The golf club attachment portion includes a fork for engaging the shaft of a golf club adjacent the head thereof. The device is also adapted for association with an elastomeric elongated extension, and this extension includes a terminal loop for engaging the head-adjacent shaft portion of a golf club.

25 Claims, 2 Drawing Sheets

GOLF EXERCISE DEVICE

FIELD OF THE INVENTION

This invention relates, in general, to exercise devices and, more specifically, to exercise devices for developing and stretching muscles used by a golfer in playing golf.

BACKGROUND OF THE INVENTION

A proper golf swing is essential if a golfer is to hit a golf ball accurately and with distance. Strength in the arms, shoulders and legs as well as timing, balance and proper weight shift are all important factors that must be mastered for a proper golf swing. In addition, suitable stretching exercises should be undertaken before attempting to briskly swing a golf club.

Typically, the muscles used in hitting a golf ball can only be effectively stretched and developed by swinging a golf club at a golf course, a driving range or on a lawn or field. However, the need to travel to the course or the driving range and the effects of adverse weather all combine to limit practice time. In addition, the demands of family and business further restrict the amount of time available for practicing outdoors.

Numerous exercise devices for indoor use have been developed that are alleged to enable a golfer to develop his or her golf-playing muscles. However, many of these prior art devices are bulky and must be permanently attached to a support surface.

Further, few golfer muscle development devices involve the use of an actual golf club. Thus, prior art devices fail to provide a golfer in training with the actual grip and feel of a golf club handle as the associated club is used in hitting a golf ball outdoors.

The present invention provides an improved exercise device for a golfer that overcomes the foregoing prior art problems and that utilizes golf clubs that are actually used by the golfer under outdoor playing conditions.

SUMMARY OF THE INVENTION

The present invention relates to an exercise device for golfers that is removably attachable to a stationary support surface and that is removably attachable to the head region of a golf club during exercise carried out using of the device.

The device incorporates both a bracket means for holding and supporting the device and a golf club head region holding means for supporting and positioning a golf club.

The present inventive device is relatively simple, small and well adapted for storage, transport (portability), and usage in various indoor environments.

The inventive device allows a golfer to develop his or her muscles while indoors at convenient times and locations.

The inventive device enables a golfer to removably associate the device with a variety of stationary surfaces including, for a presently preferred example, the top edge of a door or the like. Presently, the inventive device includes a device hanger means.

The inventive device incorporates a golf club head region attachment means that is simple, easily operated, effective and reliable. Preferably, the inventive device incorporates two such club head region attachment means, one of which is stationary and the other of which is elastomerically elongatable whereby an exercising golfer can select which such means to employ at any given time.

The inventive device provides an exercising golfer with the actual grip and feel experienced in hitting a golf ball on a golf course.

Preferably, the inventive device incorporates an elongated strip of a flattened material that is relatively rigid and comprised of metal, plastic or the like. This strip is formed so as to include conveniently and preferably a device hanger portion adjacent one end region thereof and the golf club head region attachment means for the device adjacent the opposite end region thereof.

In one presently preferred embodiment, the golfer exercise device hanger portion incorporates an inverted U-type configuration and the club head region attachment means incorporates an upwardly extending fork having a pair of laterally spaced tines. The U-configured hanger portion is adapted to extend over the upper edge of a door or the like. The forked club head region attachment means is adapted to receive and position between the tines thereof a golf club shaft in a region thereof adjacent to the club's head.

This preferred embodiment also includes in adjacent relationship to the forked club head attachment region a mounting means for associating with the exercise device an elastomeric member to which a golf club shaft adjacent to the head of the club is alternatively attachable.

The device permits a golfer to practice a variety of exercises with actual golf clubs used by the golfer under field conditions.

Other and further objects, aims, purposes, advantages, features, applications, embodiments, and the like for the present invention will be apparent from the present disclosure taken with the appended claims and the accompanying drawings.

BRIEF DESCRIPTION OF THE DRAWINGS

In the accompanying drawings that form part of the specification, and in which like numerals are employed to designate like parts throughout the same.

DETAILED DESCRIPTION

Figure 1:
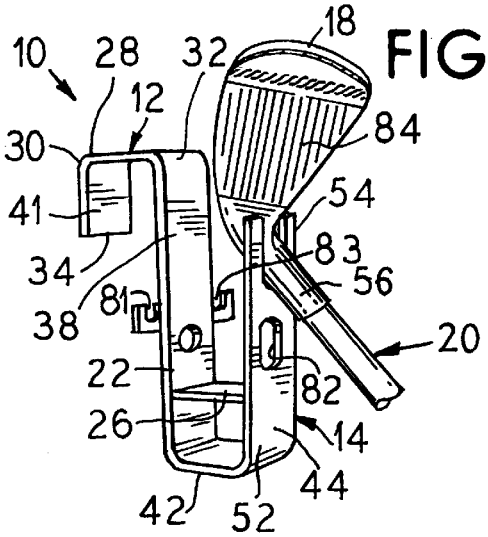
FIG. 1 is a perspective view showing the front and one side of an embodiment of the inventive golfer exercise device with the device being in functional association with the head region of an illustrative golf club.
Figure 5:
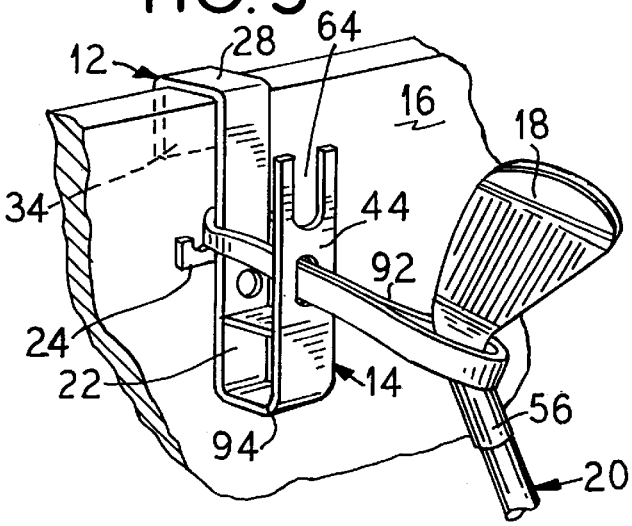
FIG. 5 is a perspective view similar to FIG. 2 but showing the device in functional association with the upper edge portion of an illustrative door (shown fragmentarily) and with the elastic band in functional association with the club head region of a golf club.

Referring now to the drawings, and to FIG. 1 in particular, there is seen an embodiment of the inventive golfer exercise device 10. The device 10 is believed to be well adapted for developing a golfer's swing. The device 10 includes a formed, elongated, flattened rigid strip 22 that has at one end a hanger portion 12 and at an opposite end a golf club head region attachment portion 14. The hanger portion 12 permits the device 10 to be removably attached to a support surface which preferably can have a stationary position, such as the top edge of a door 16 as shown in FIG. 5. While the hanger portion 12 is mounted to the top edge of the door 16, the club head region attachment portion 14 can be removably coupled to the head 18 of a golf club 20.

The device 10 can be considered to include a main coupling member or strip 22, an optional but preferred crosspiece 24 that is mounted to the strip 22, and an optional but preferred support brace or spar 26, as explained below. The main coupling member or strip 22 defines at its respective opposite ends the hanger portion 12 and the club attachment portion 14. The main coupling member or strip 22 preferably consists of a single ribbon or flattened strip of a plastic (preferably fiber reinforced), a metal, or a metal alloy, such as steel or stainless steel. The strip 22 is bent or formed into a generally sigmoidal shape as disclosed herein. Preferably, the ribbon or strip forming the main coupling member 22 has a uniform thickness which preferably is thin enough not to substantially interfere with the shutting and opening of a door when the hanger portion 12 is attached to or hooked thereover. However, as those skilled in the art will readily appreciate, the main coupling member 22 can be variously constructed and configured.

The hanger portion 12 preferably includes a generally flat or planar top portion 28 having a first end edge 30 and a second end edge 32. The width of the strip 22 and of the top 28 are preferably similar and such widths are chosen so as to achieve desired objectives for strength, overdoor engagement, and the like. The length of the top portion 28 is at least as large, and preferably slightly larger than, the width of a conventional door. A preferably flat or planar leg member 34 is integrally formed with or joined to the outer end top portion 28 and the leg member 34 extends perpendicularly from the first end edge 30. The leg member 34 is adapted to engage against one vertically extending surface of a door in order to secure the hanger portion 12 to the door. A cushion pad, not shown, may be affixed, if desired, to one side surface of the leg member 34 to protect the door from abrasion when the hanger portion 12 is mounted thereon and the exercise device 10 is used.

In the hanger portion 12, the strip 22 includes a leg member 38 that is secured to or preferably formed with top portion 28. The leg member 38 hangs from the second end edge 32 of the top portion 28. The leg member 38 preferably extends generally perpendicularly downwards from top portion 28 in spaced, parallel relationship to leg member 34 such that inner flat surfaces 40 and 41 of leg 38 and leg 34, respectively, face towards each other.

The club attachment portion 14 of the device 10 includes a preferably flat base portion 42 that preferably extends generally horizontally and a preferably vertical and preferably flat leg member 44. The base portion 42 is secured to or preferably, integrally formed with leg member 38. The base portion 42 preferably extends outwardly from the lowermost edge of the leg member 38 and extends preferably generally perpendicularly outwardly from the leg member 38. Preferably, the hanger top portion 28 and the attachment base portion 42 are in spaced, parallel relationship to each other and extend in opposite directions from the leg member 38.

Leg 44 is joined to or is integrally formed with base portion 42 and preferably projects perpendicularly from the outermost edge 46 of the base 42. The leg 44 extends preferably generally parallel to the leg member 38 and also to the leg member 34. Further, the inner preferably flat surface 48 of the leg 44 faces towards the outer preferably flat surface 50 of the leg 38.

The leg 44 has a proximal end 52 that is coupled to and is preferably integral with the base portion 42, and a distal end 54 that is adapted to removably receive the head-adjacent portion of the shaft 56 of a golf club 20. Preferably, the distal end 54 of the leg 44 is configured to define a fork 58 having two upwardly extending prongs or tines 60, 62 that are generally parallel and in laterally spaced relationship relative to each other. The tines 60, 62 define therebetween a generally U-shaped notch or gap 64 between with the upper portion 66 of the gap being open for receiving the golf club shaft 56.

Coupled to and extending between the leg member 38 and the leg 44 is a brace or spar 26 which is preferred for purposes of providing support for leg 44. The spar 26 is preferably generally flat and has a first end 70 and an opposite, second, end 72. The first end 70 is attached, preferably by welding, to the outer surface 50 of leg member 38. The spar second end 72 is similarly attached to the inner surface 48 of leg 44. Preferably, the spar 26 extends generally parallel to the base portion 42 and also to the top portion 28. Also, the spar 26 is preferably generally perpendicular to each of the leg 38 and the leg 44. It is preferred that the spar 26 be comprised of a material that is similar to that of main coupling member 22 and that spar 26 have substantially the same thickness and width as the hanger leg member 38 and the leg 44.

Preferably joined to the leg member 38 between the top portion 28 and the base portion 42 is a crosspiece 24, thereby to provide a positioning means for optional usage by a device 10 user in associating an elastic band, cord, or like member to the device 10 for exercise purposes with a golf club. The crosspiece 24 is preferably a thin flat beam of material similar to that of the main member 22 and the spar 26. The crosspiece 24 is here conveniently attached, by welding, rivets, adhesives, or the like, to the flat inner surface 40 of the leg member 38 that faces towards leg member 34. The longitudinal ends 74, 75 of the crosspiece 24 project preferably perpendicularly and equidistantly from the opposite sides of the leg member 38. Formed in the upper longitudinal side 76 of the crosspiece 24 are two preferably upwardly opening notches 78,79 that are preferably each generally U-shaped. The open upper portions 81, 83 of the notches 78, 79 are positioned proximate to the longitudinal ends 74, 75 of the crosspiece 24 and the sides of the leg member 38 such that one notch 78, 79 is adjacent to each side of the leg member 38.

A circular aperture 80 is optionally but preferably defined transversely through the leg member 38 and the aperture 80 is longitudinally located between base portion 42 and crosspiece 24. Preferably, the aperture 80 is proximate to the crosspiece 24 with the longitudinal axis of symmetry for the leg member 38 approximately bisecting the aperture.

Likewise, a generally ovally-shaped aperture 82 is optionally but preferably defined through the leg 44. The aperture 82 is preferably generally in horizontal axial alignment with the leg member aperture 80. Preferably, the longitudinal axis of symmetry for the oval 82 is aligned with the longitudinal axis of bilateral symmetry for the leg 44. Also, the length of the horizontal axis of symmetry for oval aperture 82 is preferably greater than the diameter of aperture 80. Various aperture arrangements can be employed as those skilled in the art will appreciate.

The device 10 is preferably coupled, via the hanger portion 12, to the top edge of a door 16. In mounting the hanger portion 12 to a door 16, leg 34, leg 38, and top 28 are disposed over and about the top edge of the door 16 with the leg 34 being generally adjacent to one vertically extending surface of the door, with leg 38 being generally adjacent to an opposite vertically extending surface of the door, and with the top 28 being generally located above but adjacent to the top edge of the door 16.

In use, the hanger 12 is mounted to the stationary surface provided by door 16 with the door 16 then being placed in its closed position, and the shaft 56 of a golf club 20 adjacent to head 18 is then removably placed between the prongs 60, 62 of the leg 44. The golf club head 18 is thus positioned between the leg 38 and the leg 44. As such, it is desired that the horizontal distance between the leg 38 and the leg 44 provide sufficient room to freely position golf club head 18 therebetween. Conversely, the spacing between the prongs 60, 62 restricts the golf club head 18 whereby it cannot be pulled through the prongs when abutting against the top edge portion 83 of the club face 84 of club head 18. Thus, the shaft 56 of the club 20 can pivot relative to the leg 44, while remaining secured between the prongs, as force is being applied along the longitudinal axis of the golf club shaft in a direction that is downward and away from the leg 44. This allows a golfer to pull downward on the handle (not shown) of the golf club 20 with the club 20 being located at various angles relative to the leg 44 so as to develop or stretch a golfers muscles while the head 18 of the club remains substantially stationary.

In an alternative mode of use of device 10, the device 10 may be associated with an elastomeric extension member such as shown in FIGS. 2 through 6, for example. Various elastomeric extension members can be used as those skilled in the art will readily appreciate. In one embodiment, the elastomeric extension member can comprise a stretchable elongatable endless elastomeric band or loop 86 that is formed of an elastic material, such as rubber, or a synthetic polymer. The band 86 in effect exerts a resistance to elongation or stretching. The amount of resistance to elongation or stretching is regulatable by variables such as the thickness and/or the width of the band 86 apart from the band's composition. The thickness and/or width of the band 86 may be varied between a plurality of bands to provide differences in elastic strength. Thus, the same exercise device 10 can be employed with individual ones of various bands 86 each having a different elastomeric strength either by the same exercising golfer, or by many different exercising golfers, such as children or adults, men or women, as well as by exercising golfers having different skill and strength levels.

Figure 2:
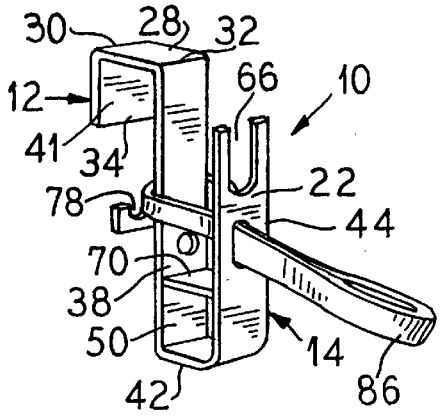
FIG. 2 is another frontal perspective view of the FIG. 1 device, but with the golf club removed and with an endless elastic band coupled to the device.
Figure 3:
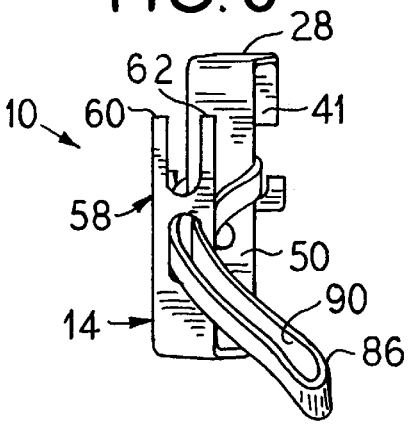
FIG. 3 is another frontal perspective view of the FIG. 1 device with the elastic band coupled thereto as in FIG. 2.

As shown, for example, in FIGS. 2, 3 and 5, the band 86 may be variously mounted to the device 10. For example, the band 86 can be connected to leg member 38 using the loop 90 of the band 86. The band 86 is thus looped around the leg 38 and against the upper longitudinal side 76 of the crosspiece 24 within the notches 78, 79. The band 86 is threaded through the oval aperture 82 in the leg 44 to provide a golf club 20 loop hold portion 92 extending from the outer side 94 of the leg 44. The loop hold portion of the band 86 can be removably coupled to the shaft 56 or club head 18 attachment sleeve of a golf club 20.

Figure 6:
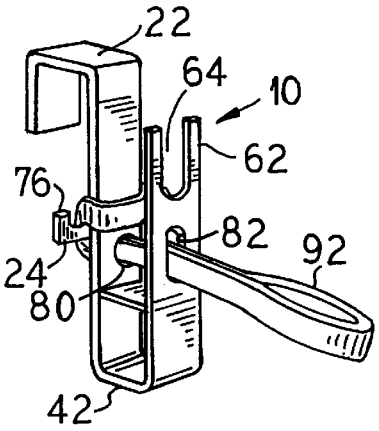
FIG. 6 is a perspective view similar to FIG. 2 but showing an alternative arrangement for coupling the elastic band to the device.

In an alternative band 86 mounting arrangement, such as shown in FIG. 6, the band 86 is looped around the leg 38 against the inner surface 40 and the upper side 76 of the crosspiece 24 within the inner surface 40 and the upper side 76 of the crosspiece 24 and also within the notches 78, 79. The band 86 extends through aperture 80 and also the aperture 82 to provide a band 86 hold portion 92.

Before use of the band 86, the device 10 is preferably associated with the band 86 and is preferably mounted to a stationary vertical surface such as a closed door in a similar manner as previously described above. Further, the hold portion 92 of the elastic band 86 is securely hooked to, or wrapped or wound around, the shaft 56 region of a golf club 20 proximate to the golf club head 18. Thus, the band 86 secures the region of the head 18 of the golf club 20 to the device 10.

The band 86 when stretched creates a counter force that is generally proportional to the distance that the band 86 has been stretched when force is applied to the shaft 56 by an exercising golfer, thereby to move the golf club head 18 away from the device 10. Thus, an exercising golfer can develop and stretch his or her muscles by gripping the handle of the golf club 20 and pulling the head 18 of the club 20 away from the device 10 while standing (or moving) in various golfer stances.

Figure 4:
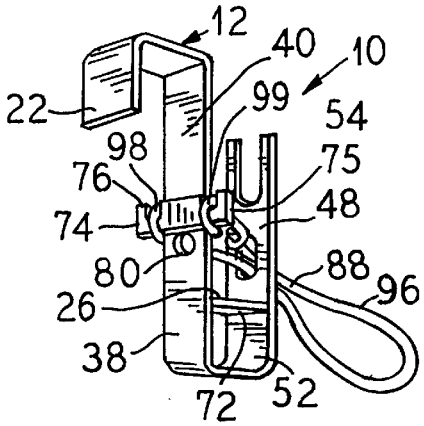
FIG. 4 is a perspective view showing the back and one side of the FIG. 1 device with the golf club removed and with a bungee cord coupled thereto in place of the elastic band.

Alternatively, the elastomeric extension member employed with the device 10 may consist of a bungee cord 88, such as shown in FIG. 4. The bungee cord 88 preferably is of conventional construction and thus includes an elastic cable 96 that is bound at each opposite end by a coiled retainer 98, 99 that each terminates in a hook that is suitable for attachment to crosspiece 24 within notches 78, 79.

The bungee cord 88 is conveniently and preferably coupled to the device 10 by hooking retainer 98 to the crosspiece 24 at notch 78 and hooking retainer 99 to the crosspiece 24 at notch 79. The elastic cable 96 is preferably threaded through aperture 82 to form a loop or hold portion 92 which extends from the flat outer side 94 of leg 44.

The device 10 including the bungee cord 88 is preferably attached to a door as described above. The loop hold portion 92 of the bungee cord 88 is removably coupled to the shaft 56 of a golf club such as club 20, near the club head such as head 18, by inserting the shaft 56 into loop portion 92 and preferably wrapping or winding the cable 96 about the club shaft 56 proximately to the club head 18. Accordingly, the bungee cord 88 flexibly couples the golf club shaft 56 about the club head 18 region to the device 10.

The bungee cord 88, like the endless band 86, creates when stretched a counter force that is generally proportional to the distance that the cord 88 has been stretched by an exercising golfer. Thus, by applying sufficient force to move the golf club head 18 away from the device 10 by stretching the bungee cord 88, an exercising golfer can develop or loosen and/or his or her golfing muscles.

Figure 7:
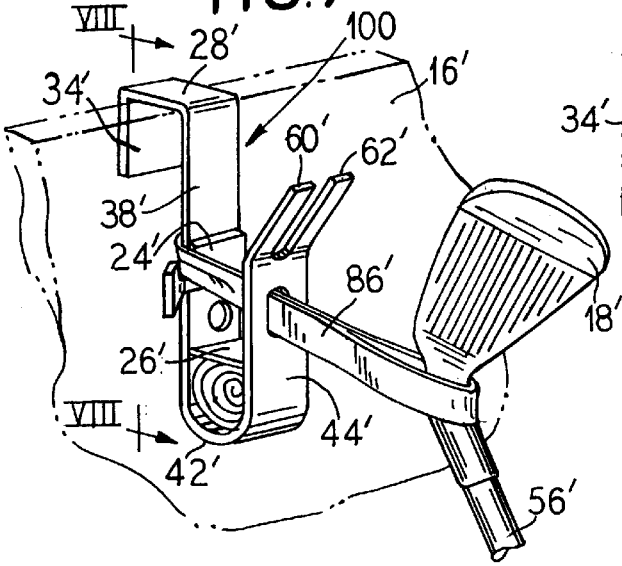
FIG. 7 is a view similar to FIG. 5, but showing an alternative embodiment of the inventive golfer exercise device.
Figure 8:
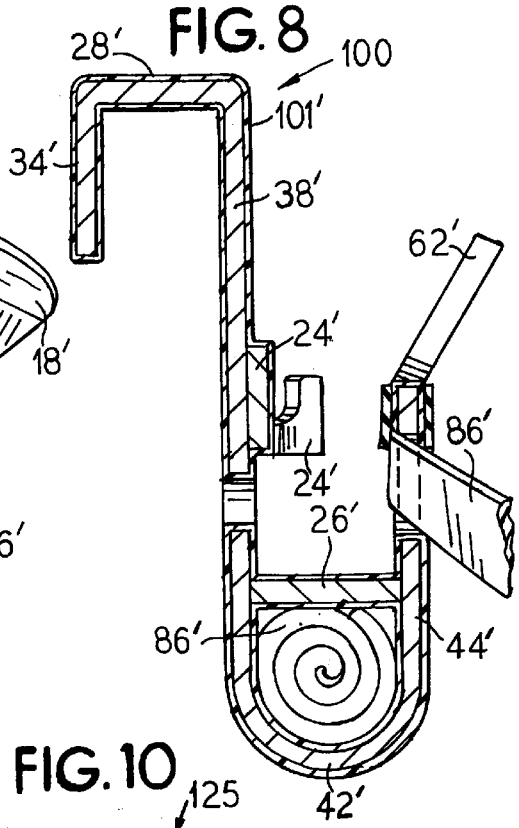
FIG. 8 is a vertical medial sectional view taken along the line VIII—VIII of FIG. 7 but showing an alternative connection arrangement for the elastomeric band and also showing an alternative elastomeric band in a storage configuration.
Figure 9:
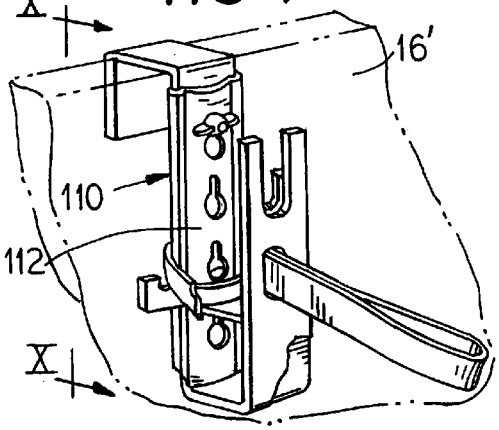
FIG. 9 is a view similar to FIG. 5 but showing a further alternative embodiment of the inventive golfer exercise device some parts thereof being broken away.
Figure 10:
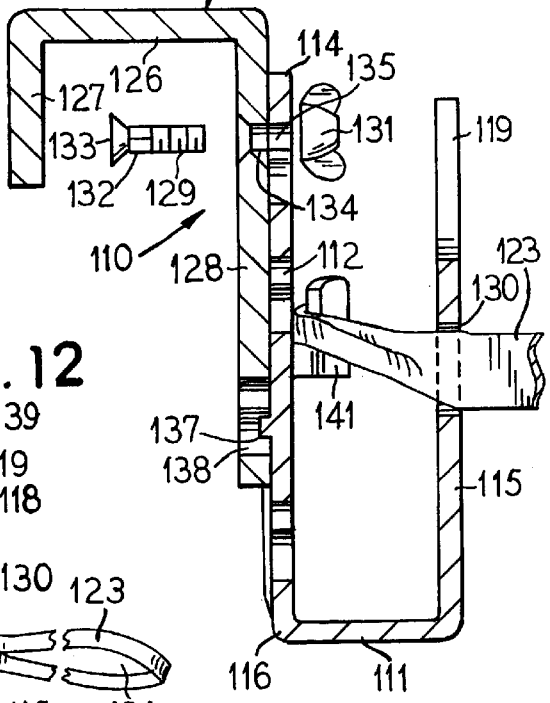
FIG. 10 is a vertical medial sectional view taken along the line X—X of FIG. 9 one part thereof being shown in exploded configuration.
Figure 11:
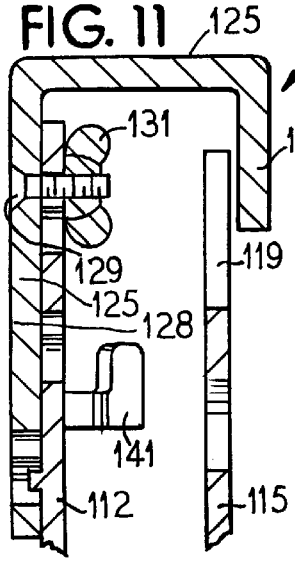
FIG. 11 is a view similar to FIG. 10 but showing the door hanger bracket in a reversed configuration for storage.

Referring to FIGS. 7 and 8, an alternative embodiment 100 of the golfer exercise device of this invention is seen. Device 100 is similar to device 10 and similar parts are similarly numbered but with the addition of prime marks thereto for convenient reference identification purposes.

In device 100, the prongs 60' and 62' of fork 58' are inclined outwardly relative to the integrally associated leg 44. The opposite end portions of the crosspiece 24' are inclined outwardly relative to leg member 38'. The leg member 38' interconnects with the leg 44' through a rounded base portion 42'. The device 100 is coated on all exterior surfaces (see FIG. 8) by any convenient procedure, such as by dipping into a fluid medium or the like followed by drying, with a thickened elastomeric polymer coating 101. The coating provides convenience in use of device 100 and avoids scratches on surfaces contacted to or against device 100. The cavity 102 defined by leg member 38', leg 44', base portion 42' and spar 26' is used for the storage of an auxiliary band 86', such as a band having a different stretch capability than the band 86'. In an alternative connection arrangement for band 86', as shown illustratively in FIG. 8, the band 86' is simply wound once around the leg 44' below the prongs 60' and 62'.

Referring to FIGS. 9–12, another alternative embodiment 110 of the golfer exercise device of this invention is seen. Device 110 has components that are similar to components in device 10 and similar components are similarly numbered but with the addition of prime marks thereto for convenient reference identification purposes.

In device 110, as in device 10, an elongated generally flattened, rigid strip member 112 is employed which has a proximal end region 114 and a distal opposite end region 116. Each of the opposite ends 114, 116 has a U-configuration. The strip member 112 can be comprised of a material like that used in the strip 22. The U-configuration at the proximal end region 114 is adapted to hook over the top edge 117 of a door 113 with the strip member 112 extending downwardly therefrom.

The U-configuration at the distal end region 116 has an upstanding terminal leg 115 relative to the strip member 112 which extends downwardly. Leg 115 is linked by a bottom leg 111 to distal end region 116. Strip 112, leg 111 and leg 115 are preferably integral with one another. The strip 112 includes a crosspiece 141 which is similar to that in device 100.

The terminal leg 115 has a forked upper end defined by a pair of upstanding prongs 118 and 119 that cooperate and are adapted to accommodate therebetween the head-adjacent shaft region 121 of a golf club 122 (not shown in FIGS. 9–12).

The golfer exercise device 110 is preferably connected to an elongated elastomeric member, here most preferably an endless elastomeric band 123 that extends outwardly from the terminal leg 115 through an aperture 130 in leg 115. The elastomeric band 123 has an outer end portion that has a loop 124 defined therein. The loop 124 is adapted to accommodate therein the head-adjacent shaft region 121 of the golf club 122. Alternatively, the elongated elastomeric member can be a bungee cord.

In the golfer exercise device 110, the U-configuration at the proximal end region 114 is defined by a U-shaped bracket member 125 which is comprised of a flat, rigid material similarly to strip 22. Bracket member 125 includes a top portion 126 and integral first and second leg portions 127 and 128, respectively, at respective opposite ends of the top portion 126. The legs 127 and 128 here illustratively each extend downwardly from the top portion 126 in spaced, adjacent, parallel relationship to one another, but various leg configurations can be used as those skilled in the art will readily appreciate. Thus, the bracket member 123 is extendable over the top edge 116 of door 117.

The second leg portion 128 is adapted to extend along, and to be in contacting, face-to-face adjacent relationship with at least an upper portion of the strip member 112. Reversible fastening means, such as a carriage bolt 129 and threadably associatable wing nut 131, is provided. The carriage bolt 129 has a square shank portion 132 in the region thereof adjacent to its head 133 (see FIG. 10). Portions of the shank 132 engage the sides of the channel 134 in second leg portion 128 and prevent rotation of bolt 129. Head 133 has cavically downwardly tapered sides that permit the head 133 to be countersunk into either one of a pair of mating receiving cavities defined in opposed relationship to each other on each side of the bolt channel 134 through second leg portion 128.

The outer surface of head 133 is flat and so is flush when fully engaged with the associated outermost surface of second leg portion 128. When the wing nut 131 is threadably associated with the shank of bolt 129 that extends through channel 134 and adjacent, aligned channel 135 in strip member 117 and tightened; the second leg portion 128 and the strip member 112 are retained in engaged relationship.

The relationship between the strip member 112 and the bracket member 125 is such that the position of the bracket member 125 relative to the strip member 112 is reversible. Thus, the top portion 126 is adapted to either overlie said top edge 116 or overlie at least a portion of the U-configuration at the distal end region 116.

In the golfer exercise device 110, the strip member 112 preferably includes a detent 137 defined therein that is adapted to engage matingly an adjacent locating channel 138 defined in the second leg portion 128 when the second leg portion is adjacent to the outside face of the strip member 112. The combination of detent 137 and channel 138 rigidities the assembly and avoids the need for a second bolt and nut fastening means.

Thus, the bracket member 125 can be either in its door-engaging position for use of device 110, or the bracket member 125 can be in its reversed position for device 110 storage. The storage position makes the device 110 more compact and permits the first leg portion 127 to overlie a portion of the prongs 118 and 119 of fork 58' (see FIG. 11) which is desirable to avoid clothing snags and the like.

Figure 12:
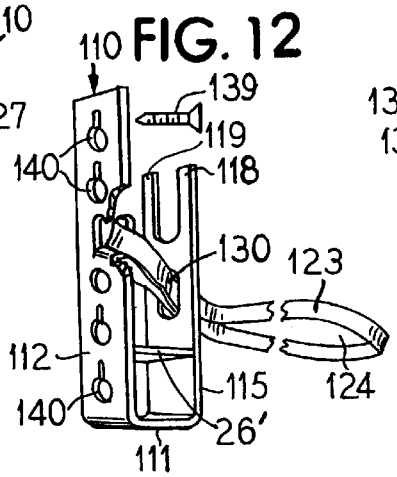
FIG. 12 is a view similar to FIG. 4 but showing the device embodiment of FIGS. 9–11 with the door hanger bracket separated so that the strip member is directly reversibly mountable against a flat surface if desired, some parts thereof being broken away and a supporting screw being illustratively shown.

When the bracket member 125 is separated from the strip member 112, the strip member 112 can be reversibly engaged with a pair of suitably vertically spaced screws 139 that are mounted with protruding heads in a flat vertical surface or the like. Thus, with the screws 139 mounted in place and with their protruding from such a surface, the strip member 112 is positioned over the screw heads so that the heads of the two screws 139 extend through a selected vertically spaced pair of the plurality of keyhole type slots 140 provided in strip member 112 that extend through the strip member 112. Once this positioning has been accomplished, the strip member 112 is moved downwardly so that the screw 139 shanks are engaged with the upper portion of each engaged keyhole slot 140, thereby anchoring temporarily the strip member 112 and the device 110 to the surface for use of the device 110. Reverse movement upwardly of the strip member 112 disengages screws 139 from the associated keyhole slots 140, and as the strip member 112 and the device 110 are separated from the support screws 139. Optionally, device 110 can be equipped with a spar 26' as shown in FIG. 12.

It will be readily apparent from the foregoing detailed description of the invention and the associated illustrations that numerous variations and modifications may be effected without departing from the spirit and scope of the novel concepts and principles of this invention.

What is claimed is:

1. A golfer exercise device comprising a coupling member having a hanger portion, an attachment portion, and an elastomeric extension member, said hanger portion having a top region for extending over an upper edge portion of a door and said coupling member including a stay portion that depends from said top region for extension along and adjacent to a vertical surface portion of said door, said elastomeric extension member operably coupled to said coupling member and defining a loop for removably attaching a golf club, said attachment portion having a distal end region that extends from said stay portion and that defines a gap for receiving the shaft of said golf club.

2. The golfer exercise device of claim 1 that includes a first leg member that depends from said top region in transversely spaced, adjacent relationship to said stay portion.

3. The golfer exercise device of claim 2 wherein said attachment portion includes a second leg member that extends in transversely spaced, adjacent relationship to said stay portion.

4. The golfer exercise device of claim 3 that includes a spar which is coupled to and extends between said stay portion and said second leg member.

5. The golfer exercise device of claim 4 wherein said second leg member includes an aperture passing therethrough and said elastomeric extension member comprises a band that is coupled to said stay portion and that extends through said aperture.

6. The golfer exercise device of claim 4 that includes a crosspiece that is attached across said stay portion and that includes crosspiece portions adapted for connection to portions of said elastomeric extension member.

7. The golfer exercise device of claim 6 wherein said second leg includes an aperture passing therethrough and said elastomeric extension member comprises a bungee cord whose opposite ends are each attached to portions of said crosspiece and said bungee cord extends through said aperture.

8. The golfer exercise device of claim 1 which is generally sigmoidally shaped in side elevation.

9. A golfer exercise device comprising:

a hanger portion, a stay portion extending from said hanger portion, an attachment portion extending from said stay portion, and an elastomeric extension member;

said hanger portion being removably mountable to a stationary surface, said hanger portion including a top and a first leg that extends from said top in transversely spaced, adjacent relationship to said stay portion;

said stay portion extending from said top;

said elastomer extension member operably coupled to said stay portion that defines a hold loop for removably attaching to a golf club;

said attachment portion including a base and a second leg that extends from said base in transversely spaced relationship to said stay portion, said second leg having a generally upstanding distal end that defines a fork having a pair of spaced prongs for receiving therebetween the shaft of said golf club adjacent the head thereof.

10. The golfer exercise device of claim 9 that includes a crosspiece attached across said stay portion.

11. The golfer exercise device of claim 10 wherein said crosspiece has a pair of notches defined therein, each notch being adjacent to a different outwardly extending opposite end of said crosspiece.

12. The golfer exercise device of claim 9 that includes a spar that is coupled to and extends between said stay portion and said second leg member.

13. The golfer exercise device of claim 12 wherein said spar extends in spaced, parallel relationship to said base.

14. The golfer exercise device of claim 9 wherein said second leg member includes a transverse aperture therethrough.

15. The golfer exercise device of claim 14 that further includes said elastomeric extension member extending through said aperture.

16. The golfer exercise device of claim 1 wherein said elastomeric extension member comprises a bungee cord whose opposite ends are attached to respective opposite ends of a crosspiece that is attached across said stay portion.

17. The golfer exercise device of claim 15 wherein said elastomeric extension member is an endless elastomeric band, and said band extends through said aperture.

18. The golfer exercise device of claim 9 which is generally sigmoidally shaped in side elevation.

19. A golfer exercise device comprising:

an elongated generally flattened, rigid strip member having a proximal end region and a distal opposite end region each of said opposite ends having a U-configuration;

said U-configuration at said proximal end region being adapted to hook over the top edge of a door with said strip member extending downwardly;

said U-configuration at said distal end region having an upstanding terminal leg when said strip member so extends downwardly;

said terminal leg having a forked upper end with a pair of upstanding prongs and an elongated elastomeric member that extends outwardly from said terminal leg, said prongs adapted to accommodate therebetween the head adjacent shaft region of a golf club.

20. The golfer exercise device of claim 19 wherein said terminal leg has an upper end, said upper end has a fork defined therein, said fork has a pair of laterally spaced, upstanding prongs, and the lateral spacing between said prongs is at least sufficient to accommodate therebetween the head-adjacent region of a golf club.

21. The golfer exercise device of claim 20 wherein said elastomeric member has an outer end portion that has a loop defined therein, said loop being adapted to accommodate therein the head-adjacent shaft region of a golf club.

22. The golfer exercise device of claim 21 wherein said elastomeric member is an endless elastomeric band.

23. The golfer exercise device of claim 21 wherein said elastomeric member is a bungee cord.

24. The golfer exercise device of claim 19 wherein:

said proximal end U-configuration is defined by a U-shaped bracket member which comprises a top portion and integral first and second leg portions at respective opposite ends of said top portion which legs each extend downwardly from said top portion in spaced adjacent, parallel relationship to one another whereby said bracket is so extendable over said top edge;

said second leg portion being adapted to extend along and in contacting adjacent relationship relative to at least an upper portion of said strip member;

nut and bolt means extending through an adjacent portion of said second leg portion and also said strip member for retaining said second leg portion in engaged relationship with said strip member;

the relationship between said strip member and said bracket member being such that the position of said bracket member relative to said strip member is reversible whereby said top portion is adapted to either overlie said top edge or overlie at least a portion of said U-configuration at said distal end region.

25. The golfer exercise device of claim 24 wherein said strip member includes detent means that are adapted to engage matingly an adjacent portion of said second leg.

* * * * *

UNITED STATES PATENT AND TRADEMARK OFFICE

CERTIFICATE OF CORRECTION

PATENT NO : 5,957,819

DATED : September 28, 1999

INVENTOR(S) : Gary A. Cortesi

It is certified that error appears in the above-identified patent and that said Letters Patent is hereby corrected as shown below:

Column 4, line 18, delete "46" after --outermost edge--.

Column 5, line 39, delete "83" after --edge portion--.

Column 8, line 4, delete "member 123" and insert --member 125--.

Column 8, line 26, delete "member 117" and insert --member 112--.

Column 8, lines 39 and 40, delete "rigidities" and insert --rigidifies--.

Signed and Sealed this

Twenty-third Day of May, 2000

*Attest:*

Q. TODD DICKINSON

*Attesting Officer*

*Director of Patents and Trademarks*